US007339555B2

(12) United States Patent
Jeong

(10) Patent No.: US 7,339,555 B2
(45) Date of Patent: Mar. 4, 2008

(54) METHOD AND APPARATUS FOR DISPLAYING AN IMAGE ON A PLASMA DISPLAY PANEL

(75) Inventor: Jae-Seok Jeong, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 590 days.

(21) Appl. No.: 10/974,999

(22) Filed: Oct. 28, 2004

(65) Prior Publication Data

US 2005/0093780 A1 May 5, 2005

(30) Foreign Application Priority Data

Oct. 31, 2003 (KR) ..... 10-2003-0076971

(51) Int. Cl.
*G09G 3/28* (2006.01)

(52) U.S. Cl. ..... 345/60; 345/63

(58) Field of Classification Search ..... 345/60–65; 315/169.1, 169.2, 169.3, 169.4; 313/582, 313/584, 586, 633
See application file for complete search history.

(56) References Cited

U.S. PATENT DOCUMENTS 6,335,735 B1 * 1/2002 Denda et al. ..... 345/589
7,221,335 B2 * 5/2007 Jeong ..... 345/63
2004/0164934 A1 * 8/2004 Jeong ..... 345/63
2005/0062690 A1 * 3/2005 Jeong ..... 345/63
2005/0073616 A1 * 4/2005 Joo et al. ..... 348/797
2005/0264476 A1 * 12/2005 Kim et al. ..... 345/60
2005/0264483 A1 * 12/2005 Jeong ..... 345/63

FOREIGN PATENT DOCUMENTS

| | | |
|---|---|---|
| JP | 10-319903 | 12/1998 |
| JP | 2002-221934 | 8/2002 |
| KR | 2000-0016955 | 3/2000 |
| KR | 10-2003-0039282 | 5/2003 |

* cited by examiner

*Primary Examiner*—Nitin I. Patel
(74) *Attorney, Agent, or Firm*—H.C. Park & Associates, PLC

(57) ABSTRACT

A method and apparatus for displaying an image on a plasma display panel. Each of a plurality of subfields has three consecutive subfield groups in time order, and the luminance weight of the subfields in a second subfield group among the three subfield groups is set to be smaller than the luminance weight of a lowermost subfield in the first subfield group and the luminance weight of a lowermost subfield in the third subfield group. Further, the starting positions of the second subfield group and the third subfield group in time order change according to the load ratio of the image signal.

16 Claims, 8 Drawing Sheets

(a)

(b)

| subfield | SF1 | SF2 | SF3 | SF4 | SF5 | SF6 | SF7 | | SF1 | SF2 | SF3 | SF4 | SF5 | SF6 | SF7 | |
|---|---|---|---|---|---|---|---|---|---|---|---|---|---|---|---|---|
| weight / gray level | 1 | 4 | 8 | 16 | 24 | 32 | 40 | idle period | 2 | 4 | 8 | 16 | 24 | 32 | 40 | idle period |
| 0 | | | | | | | | | | | | | | | | |
| 1 | ◎ | | | | | | | | | | | | | | | |
| 2 | | | | | | | | | ◎ | | | | | | | |
| 3 | ◎ | | | | | | | | ◎ | | | | | | | |
| 4 | | | | | | | | | | ◎ | | | | | | |
| 5 | ◎ | | | | | | | | | ◎ | | | | | | |
| 6 | | ◎ | | | | | | | ◎ | | | | | | | |
| 7 | ◎ | ◎ | | | | | | | ◎ | | | | | | | |
| 8 | | ◎ | | | | | | | | ◎ | | | | | | |
| 9 | ◎ | ◎ | | | | | | | | ◎ | | | | | | |
| 10 | | ◎ | | | | | | | ◎ | ◎ | | | | | | |
| 11 | ◎ | ◎ | | | | | | | ◎ | ◎ | | | | | | |
| | G1 | | | | | | | | G2 | | | | | | | |

| subfield | SF1 | SF2 | SF3 | SF4 | SF5 | SF6 | | SF1 | SF2 | | SF1 | SF2 | SF3 | SF4 | SF5 | SF6 | |
|---|---|---|---|---|---|---|---|---|---|---|---|---|---|---|---|---|---|
| weight | 4 | 8 | 16 | 24 | 32 | 40 | idle period | 1 | 2 | idle period | 4 | 8 | 16 | 24 | 32 | 40 | idle period |
| | G1 | | | | | | | G2 | | | G3 | | | | | | |

| subfield | SF1 | SF2 | SF3 | SF4 | SF5 | SF6 | | SF1 | SF2 | | SF1 | SF2 | SF3 | SF4 | SF5 | SF6 | |
|---|---|---|---|---|---|---|---|---|---|---|---|---|---|---|---|---|---|
| weight / gray level | 4 | 8 | 16 | 24 | 32 | 40 | idle period | 1 | 2 | idle period | 4 | 8 | 16 | 24 | 32 | 40 | idle period |
| 0 | | | | | | | | | | | | | | | | | |
| 1 | | | | | | | | ◎ | | | | | | | | | |
| 2 | | | | | | | | | ◎ | | | | | | | | |
| 3 | | | | | | | | ◎ | ◎ | | | | | | | | |
| 4 | | | | | | | | | | | ◎ | | | | | | |
| 5 | | | | | | | | ◎ | | | ◎ | | | | | | |
| 6 | | | | | | | | | ◎ | | ◎ | | | | | | |
| 7 | | | | | | | | ◎ | ◎ | | ◎ | | | | | | |
| 8 | ◎ | | | | | | | | | | ◎ | | | | | | |
| 9 | ◎ | | | | | | | ◎ | | | ◎ | | | | | | |
| 10 | ◎ | | | | | | | | ◎ | | ◎ | | | | | | |
| 11 | ◎ | | | | | | | ◎ | ◎ | | ◎ | | | | | | |
| | G1 | | | | | | | G2 | | | G3 | | | | | | |

(a)

(b)

(a)

(b)

METHOD AND APPARATUS FOR DISPLAYING AN IMAGE ON A PLASMA DISPLAY PANEL

CROSS REFERENCE TO RELATED APPLICATION

This application claims priority to and the benefit of Korean Patent Application No. 10-2003-0076971, filed on Oct. 31, 2003, which is hereby incorporated by reference for all purposes as if fully set forth herein.

BACKGROUND OF THE INVENTION

1. Field of the Invention

The present invention relates to a method and an apparatus for displaying an image on a plasma display panel (PDP), and more particularly, to a method and an apparatus for displaying an image on a PDP having reduced flicker and pseudo-contour.

2. Discussion of the Related Art

A PDP transforms an input electrical signal into image data by selectively illuminating discharge cells arranged in a matrix form.

A color PDP expresses gray levels by time dividing one field into a plurality of subfields.

A viewer may easily see flicker when the screen is large and the frequency of the input signal is small.

Hence, displaying an image from a phase alternate line (PAL) image signal, which has a 50 Hz frequency, on a PDP may generate a large amount of flicker. Accordingly, a large amount of flicker may be generated when the PDP is driven with a vertical frequency of 50 Hz using conventional subfield arrangements such as a minimum increase arrangement or a minimum decrease arrangement. Since the PDP's screen size cannot be adjusted, the flicker must be reduced by accounting for the low frequency.

Korean laid-open patent application No. 2000-16955 discloses a method for suppressing the generation of flicker in a PDP. As shown in FIG. 1, a subfield in one frame may be divided into two groups G1 and G2 that except for the least significant bit LSB subfield, may be constructed identically or similarly to each other. This method may reduce the flicker as compared to conventional subfield arrangement methods such as the minimum increase arrangement or the minimum decrease arrangement.

Referring to FIG. 1, the entire period of one frame is 20 ms, and the period for groups G1 and G2 is 10 ms. An idle period 1 exists at the end of group G1, and an idle period 2 exists at the end of group G2.

FIG. 2 shows an example where a part of the low gray level is realized with the subfield arrangement of FIG. 1.

As shown in FIG. 2, when low gray levels, such as the gray levels 0 to 11, are expressed with the subfield arrangement of FIG. 1, the time difference between the subfields corresponding to the least significant bit (LSB) and LSB+1 may be about several ms.

For example, for the gray level 3, the lowermost subfield SF1 in the first group G1 and the lowermost subfield SF1 in the second group G2 are turned on. In this case, the subfield SF1 in the first group G1 is the LSB subfield, the subfield SF1 in the second group G2 is the LSB+1 subfield, and the time difference between them is about 10 ms.

When expressing the low gray level with the subfield arrangement above and by applying error diffusion, there may be a large time difference of several ms between the LSB and LSB+1 subfields. This may generate significant pseudo-contour at the boundary between the gray levels of a moving image since the continuation time of illumination with such a time difference may be short.

FIG. 3 shows the mechanism in which the pseudo-contour is generated due to a moving image having neighboring gray levels of 4 and 3. As shown in FIG. 3, the pseudo-contour generates about 5 spots, and the difference between the maximum gray level 4 among the original gray levels and the distorted gray level is 2, 1, 3, 2, and 1.5, respectively, according to the occurring position, indicating the intensity of pseudo-contour generation. The gray level distorted as such while the image is moving results in the distortion of color, which a viewer may recognize as a color distortion having the shape of the contour.

Korean laid-open patent application No. 2003-39282 discloses technology to solve the problem of the above laid-open patent. As shown in FIG. 4, the subfields in one frame may be divided into three groups G1, G2, and G3, and the middle group G2 may have a smaller luminance weight than the lowermost subfields in the groups G1 and G3. This method may reduce the pseudo-contour as compared to the method of dividing the subfields into two groups, and it may reduce the flicker as compared to other subfield arrangement methods such as the conventional minimum increase arrangement or minimum decrease arrangement.

Referring to FIG. 4, the entire period of one frame is 20 ms, in which the first group G1 begins at 0 ms and ends before 8.5 ms, the second group G2 begins at 8.5 ms and ends before 10.8 ms, and the third group G3 begins at 10.8 ms and ends before 20 ms. Three idle periods are located at the ends of the three groups G1, G2, and G3.

FIG. 5 shows an example in which a part of the low gray levels is realized with the subfield arrangement of FIG. 4.

As shown in FIG. 5, when low gray levels, such as the gray levels 0 through 11, are expressed with the subfield arrangement of FIG. 4, the LSB and LSB+1 subfields are located in the middle subfield group G2 to reduce the time difference between the subfields, which reduces the pseudo-contour at the boundary between the gray levels while the image at the low gray level is moving.

The PDP consumes a large amount of power due to its driving characteristic, so Automatic Power Control (APC) technology may be used to control the power consumption according to the load ratio or the average signal level of a frame to be displayed. The APC technology is a method in which the APC levels change according to the load ratio of the input image data, and the number of sustain pulses change at each APC level to restrict the power consumption to below a certain level.

According to the APC technology, therefore, the number of sustain pulses applied to the respective subfields change according to the load ratio. Referring to the subfield arrangement of FIG. 4, all sustain pulses applied to the groups G1, G2 and G3 are changed according to the load ratio. Accordingly, the subfields have a number of sustain pulses corresponding to their luminance weight, so the number of sustain pulses applied to the respective subfields may also change.

FIG. 6 shows the position of subfield groups and the central position of illumination at each load according to the conventional subfield construction of FIG. 4, in which (a) shows the case of the minimum load ratio, and (b) shows the case of the maximum load ratio.

As shown in (a) of FIG. 6, in the case of the minimum load ratio, the time difference A between the central positions of illumination from the first group G1 to the third group G3 is larger than the time difference B between the central positions of illumination from the third group G3 to the first group G1. As shown in (b) of FIG. 6, in the case of the maximum load ratio, the time difference C between the central positions of illumination from the first group G1 to the third group G3 is larger than the time difference D between the central positions of illumination from the third group G3 to the first group G1. Consequently, the time difference between the central positions of illumination of the groups G1 and G3, which are the more important subfield groups in the frame, is larger than the time difference between the two groups in successive frames irrespective of the load ratio.

Accordingly, there is a problem in the conventional art where when dividing one frame into three subfield groups, flicker may easily occur since the fixed starting positions St_2 and St_3 of the second and third subfield groups may cause a lack of periodicity of the central position of illumination.

SUMMARY OF THE INVENTION

The present invention provides a method and an apparatus for displaying an image on a PDP having reduced flicker by maintaining periodicity of the central positions of illumination between subfield groups.

Additional features of the invention will be set forth in the description which follows, and in part will be apparent from the description, or may be learned by practice of the invention.

The present invention discloses a method for displaying an image on a plasma display panel, comprising dividing an image of each frame displayed thereon into a first subfield group, a second subfield group, and a third subfield group and expressing a gray level by luminance weights of subfields in the subfield groups. The first subfield group, the second subfield group, and the third subfield group are arranged consecutively in time order, and starting positions of the second subfield group and the third subfield group in time order change according to a load ratio of an input image signal.

The present invention also discloses a method for displaying an image on a plasma display panel that divides an image of each frame displayed thereon in accordance with an image signal to a plurality of subfields and expresses a gray level by a combination of luminance weights of the subfields, wherein each of the plurality of subfields consists of three consecutive subfield groups, and central positions of illumination between the subfield groups in one frame or in different frames have periodicity when a load ratio of the image signal is larger than a specific value.

The present invention also discloses an apparatus for displaying an image on a plasma display panel that divides an image of each frame displayed thereon in accordance with an image signal to a plurality of subfields and expresses gray level by a combination of luminance weights of the subfields. The apparatus comprises an image signal processor, a vertical frequency detector, a memory controller, an APC portion, a subfield changing range determiner, and a sustain/scan pulse driving controller. The image signal processor digitizes the input image signal to generate digital image data. The vertical frequency detector analyzes the digital image data output from the image signal processor to detect a type of the image signal, and outputs a detected result as a data switch value together with the digital image data. The memory controller receives the digital image data and the data switch value generated by the vertical frequency detector, and generates subfield data corresponding to the type of image signal, wherein the subfield data comprises a first subfield group, a second subfield group, and a third subfield group arranged consecutively in time order when the image signal is of a first type. The automatic power control (APC) portion detects a load ratio of the digital image data output from the vertical frequency detector, calculates an APC level according to the detected load ratio, and calculates and outputs a sustain pulse number corresponding to the calculated APC level. The subfield changing range determiner determines a changing range of the second subfield group and the third subfield group according to the load ratio output from the APC portion, and determines starting positions of the second subfield group and the third subfield group within the determined changing range. The sustain/scan pulse driving controller receives the sustain pulse number, the starting positions of the second subfield group and the third subfield group, and the data switch value, generates subfield arrangement construction according to the type of the image signal, and generates a control signal based on the subfield arrangement construction to apply to the plasma display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figures 1, 2:
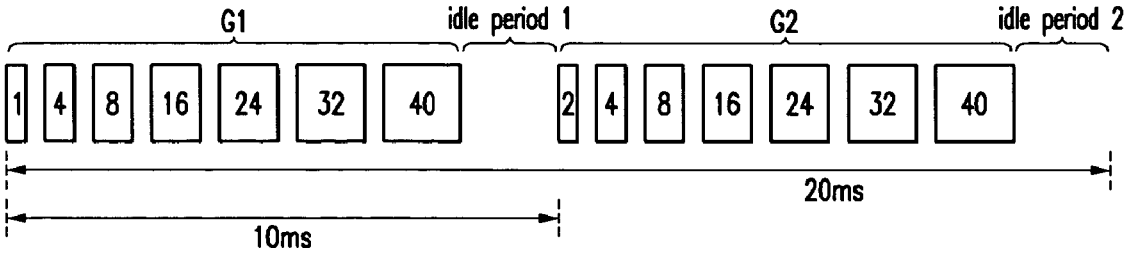
FIG.1 Prior Art
FIG.2 Prior Art
FIG. 1 shows a conventional PDP subfield arrangement.
FIG. 2 shows an example in which a part of a low gray level is realized with the subfield arrangement of FIG. 1.

In the following detailed description shows and describes exemplary embodiments of the invention, simply by way of illustration of the best mode contemplated by the inventor of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

Hereinafter, a method for displaying images on a PDP according to exemplary embodiments of the present invention will be described in greater detail with reference to the accompanying drawings.

Figure 7:
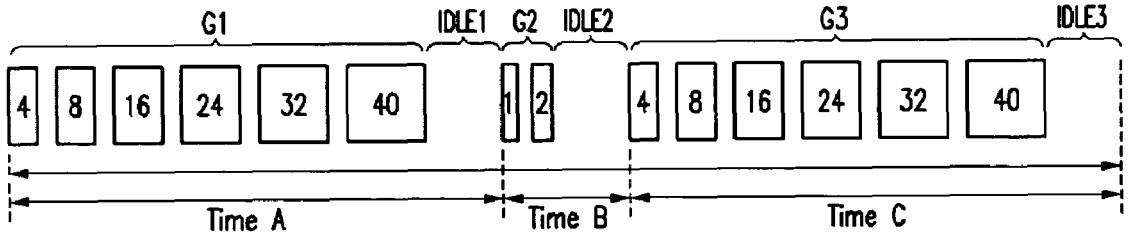
FIG. 7 shows the subfield construction according to an exemplary embodiment of the present invention.

FIG. 7 shows the subfield construction according to an exemplary embodiment of the present invention.

As shown in FIG. 7, the subfields according to an exemplary embodiment of the present invention consist of three individual subfield groups G1, G2, and G3. Further, the idle period IDLE1 of the first group G1, the idle period IDLE2 of the second group G2, and the idle period IDLE3 of the third group G3 are located at the ends of the subfield groups G1, G2 and G3, respectively.

The first subfield group G1 and the third subfield group G3 have identical subfield construction consisting of six, equally weighted subfields. The six subfields have weight values that are set, from the subfield at the lower position, at 4, 8, 16, 24, 32, and 40, however, these weights may be modified.

The second subfield group G2 has two subfields with luminance weights of 1 and 2, respectively, so that the weight of both subfields is smaller than the weights of the subfields in the first subfield group G1 and the third subfield group G3. The luminance weights for the second subfield group G2 may vary according to the luminance weights set to the first subfield group G1 and the third subfield group G3. In other words, the subfields in the second subfield group G2 may correspond to the LSB and LSB+1 subfields among the subfields in the entire frame. Here, it is exemplified as LSB and LSB+1, however, the technical scope of the present invention is not restricted to that example, and it can be applied to the lower bits.

The sum of the first time Time A, which includes the time corresponding to the first subfield group G1 and the idle period IDLE1, the second time Time B, which includes the time corresponding to the second subfield group G2 and the idle period IDLE2, and the third time Time C, which includes the time corresponding to the third subfield group G3 and the idle period IDLE3, is set to be the time of one frame, i.e. 20 ms.

The first time Time A may be equal to the third time Time C. Alternatively, the first time Time A may be slightly larger than the third time Time C, or the third time Time C may be slightly larger than the first time Time A.

Furthermore, the first time Time A and the third time Time C may be set to be larger than the second time Time B. Accordingly, regarding the idle periods corresponding to the respective subfield groups G1, G2 and G3, the idle period IDLE1 and the idle period IDLE3 may be set to be larger than the idle period IDLE2.

As described above, the frame is divided into three subfield groups G1, G2, and G3, a time of which includes the corresponding idle period, and the starting positions of the subfield groups G2 and G3 may be changed according to the set time.

Figure 8:
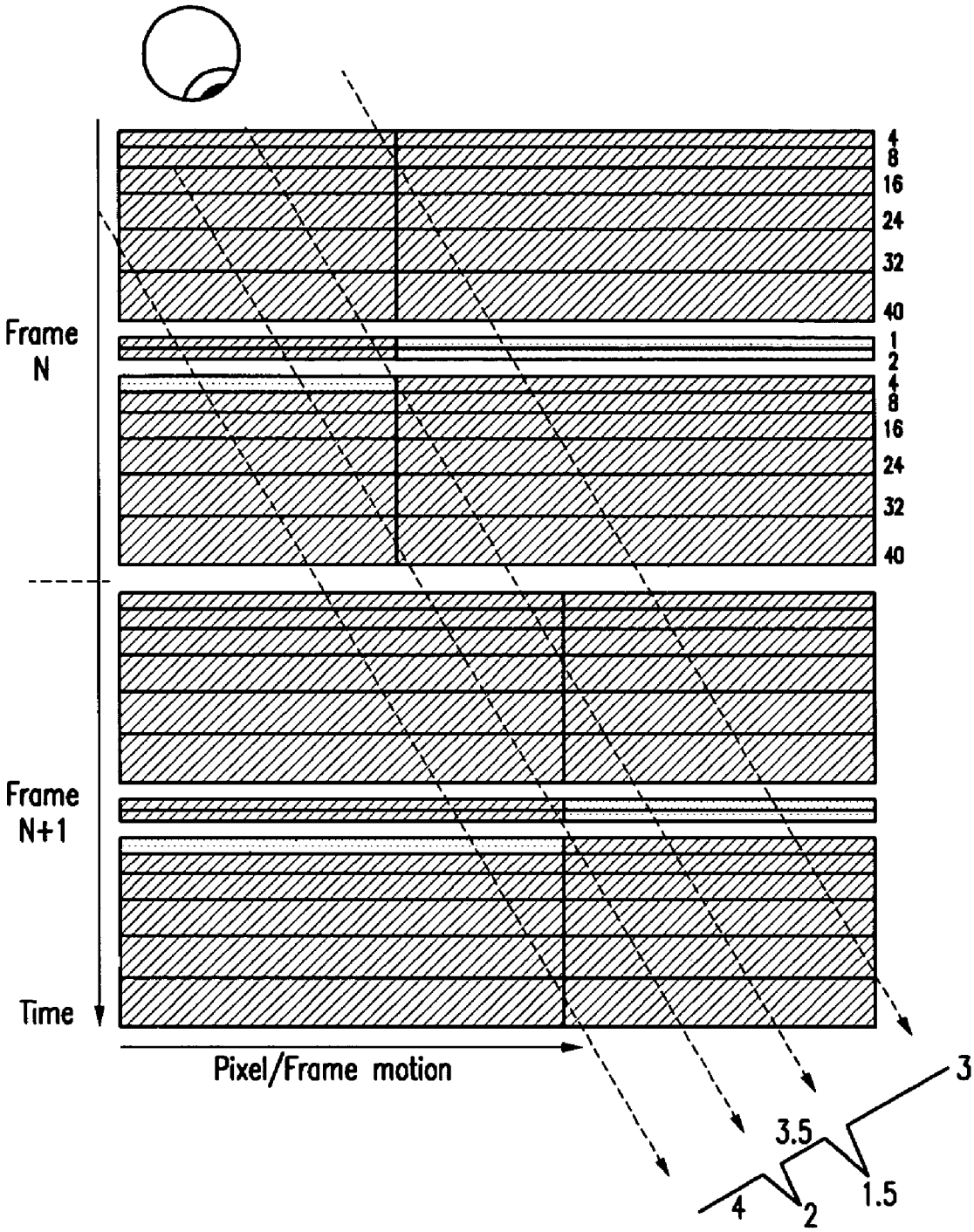
FIG. 8 shows the mechanism of generation of pseudo-contour generated by a moving image having neighboring gray levels of 4 and 3 in the subfield arrangement according to an exemplary embodiment of the present invention.

FIG. 8 shows the mechanism of generation of pseudo-contour generated by a moving image having neighboring gray levels of 4 and 3 in the subfield arrangement according to an exemplary embodiment of the present invention.

As shown in FIG. 8, the pseudo-contour occurs at three positions while the image having neighboring gray levels of 4 and 3 is moving, and the difference of the maximum gray level (gray level 4) among the original gray levels and the distorted gray level is 2, 0.5, 2.5, according to the occurred position. In this instance, the point with the gray scale of 3.5 has very weak intensity of the contour noise from among the points at which the contour noise has been generated, and hence, the above-noted point is deemed to substantially have no contour noise. Therefore, the number of generated pseudo-contours may be reduced by three in comparison with the conventional PDP subfield construction described with reference to FIG. 3, and the difference between the distorted gray level and the original gray level may be reduced to a quarter.

Figure 3:
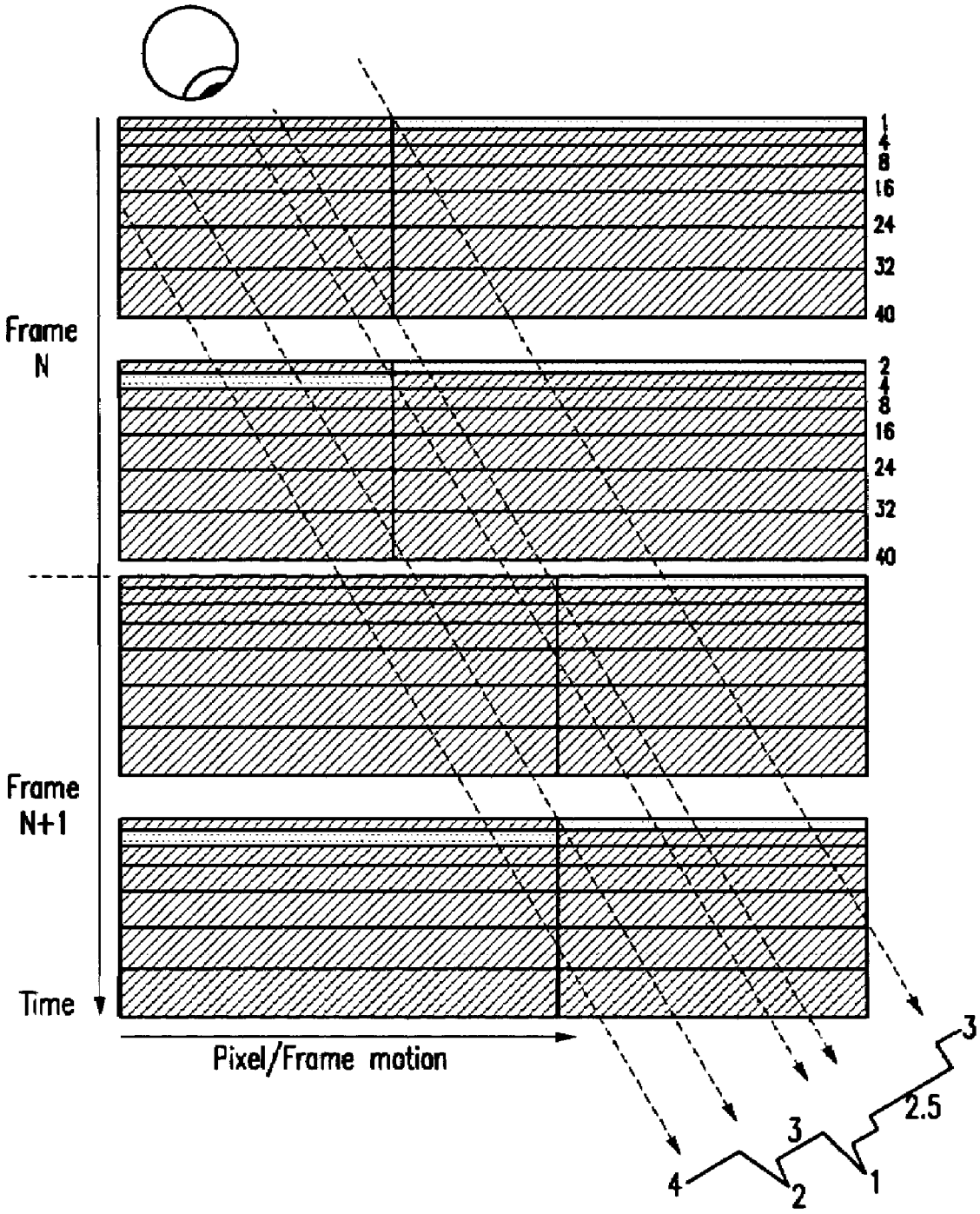
FIG.3 Prior Art
FIG. 3 shows the mechanism of generation of pseudo-contour generated by a moving image having neighboring gray levels of 4 and 3 in the subfield arrangement of FIG. 1.

Accordingly, in the subfield construction according to an exemplary embodiment of the present invention, the pseudo-contour may be reduced in comparison with the conventional PDP subfield construction shown in FIG. 1 to FIG. 3.

Hereinafter describes the subfield construction, the subfield position and the central position of illumination when the APC is performed according to the load ratio according to an exemplary embodiment of the present invention.

Figure 9:
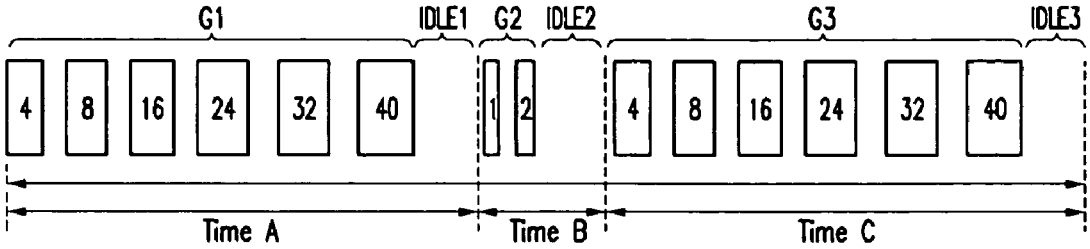
FIG. 9 shows a modification of the subfield construction according to the APC in an exemplary embodiment of the present invention, in which (a) shows the case of the minimum load ratio, and (b) shows the case of the maximum load ratio.
Figure 9:
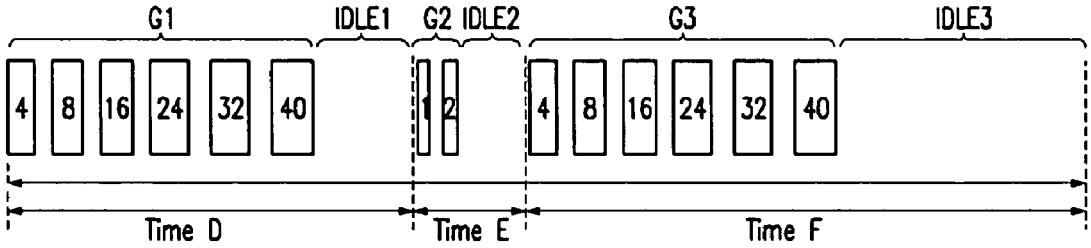

FIG. 9 shows a modification of the subfield construction according to the APC in an exemplary embodiment of the present invention, in which (a) shows the case of the minimum load ratio, and (b) shows the case of the maximum load ratio.

Referring to (a) in FIG. 9, the number of sustain/discharge pulses used for sustain and discharge becomes maximum at the minimum load ratio, so the sum of the idle periods IDLE1, IDLE2, and IDLE3 become minimum.

However, referring to (b) in FIG. 9, the number of sustain/discharge pulses used for the sustain and discharge becomes minimum at the maximum load ratio, so the sum of the idle periods IDLE1, IDLE2, and IDLE3 become maximum.

In such a subfield construction, the sum of the first through third times Time A, B and C in (a), and the sum of first through third times Time D, E and F in (b), is set to be the time of one frame, i.e. 20 ms. Therefore, whether the load ratio is a minimum or a maximum load ratio, the frame time is set at 20 ms.

The first time Time A and Time D may be equal to the third time Time C and Time F, respectively. However, the first time Time A and Time D may be slightly larger than the third time Time C and Time F, respectively, or the third time Time C and Time F may be slightly larger than the first time Time A and Time D, respectively.

Further, the first time Time A and Time D may be smaller than the sum of the second time Time B and Time E and the third time Time C and Time F, respectively.

Furthermore, the first time Time A and Time D, and the third time Time C and Time F, may be larger than the second time Time B and Time E, respectively. Accordingly, the idle times IDLE1 and IDLE3 may be larger than the idle time IDLE2.

As shown in (b) of FIG. 9, since the number of sustain/discharge pulses assigned to each subfield becomes minimum in the case of the maximum load ratio, the time Time D becomes smaller than the time Time A when the load ratio is not minimum, which is the case when the load ratio is maximum. Therefore, the starting positions of the second subfield group G2 and the third subfield group G3 may be advanced in time when the load ratio is maximum in comparison with their starting positions when the load ratio is not maximum. For example, assuming that the starting positions of the second subfield group G2 and the third subfield group G3 are 8 ms and 10 ms, respectively, in the case of the minimum load ratio, the starting positions may be advanced to 6 ms and 8 ms, respectively, in the case of the maximum load ratio. In that situation, as the entire idle period in one frame is largest in the case of the maximum load ratio, the idle periods IDLE1 and IDLE 3 may be large in comparison with those in the case of the minimum load ratio, and simultaneously, the idle period IDLE3 of the third subfield group G3 may be larger than the idle period IDLE1 of the first subfield group G1.

The above example illustrates the case in which the starting positions of the second subfield group G2 and the third subfield group G3 are advanced in time in the case of the maximum load ratio as compared to those in the case of the minimum load ratio. However, referring to the above description, it can be easily understood by those skilled in the art that the starting positions of the second subfield group G2 and the third subfield group G3 may also be advanced even when the load ratio is not changed from the minimum to the maximum. In other words, the starting positions may be advanced due to an increase in the load ratio that is less than the increase from minimum to maximum.

Figure 10:
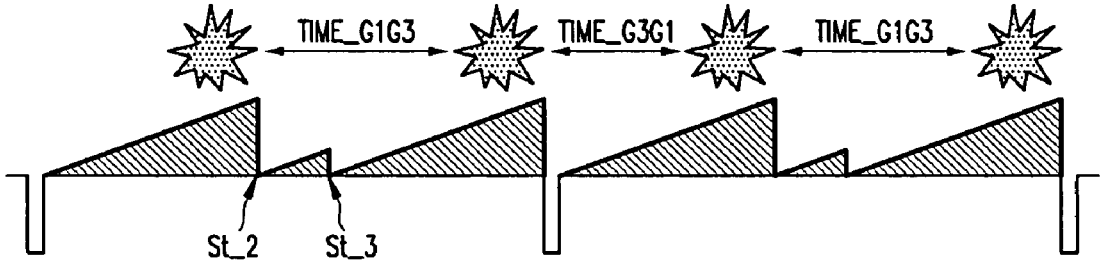
FIG. 10 shows the position of subfields and the central position of illumination for the subfield construction of FIG. 9, in which (a) shows the case of the minimum load ratio, and (b) shows the case of the maximum load ratio.
Figure 10:
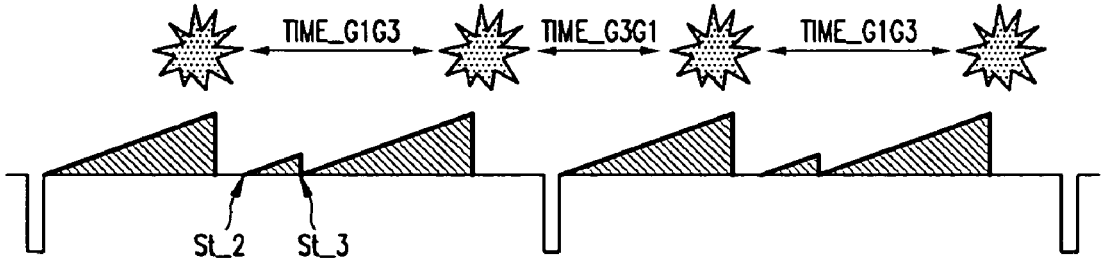

FIG. 10 shows the positions of subfields and the central position of illumination regarding the subfield construction as shown in FIG. 9, in which (a) shows the case of the minimum load ratio, and (b) shows the case of the maximum load ratio.

As shown in (a) of FIG. 10, in the case of the minimum load ratio, the number of sustain/discharge pulses is maximum, and the idle periods IDLE1, IDLE2, and IDLE3 become minimum. In this case, the first time difference Time_G1G3 between the central positions of illumination of the first subfield group G1 and the third subfield group G3 in a same frame may be larger than the second time difference Time_G3G1 between the central position of illumination of the third subfield group G3 and a central position of illumination of the first subfield group G1 in the next frame. In other words, the Time_G1G3>the Time_G3G1. Here, the central positions of illumination of the respective subfield groups depend on the most significant bit (MSB) subfield of the respective subfield groups, so it is assumed that the central positions of illumination are located at the corresponding MSB subfields.

Accordingly, a certain amount of flicker may occur in the case of the minimum load ratio, however, the amount of pseudo-contour may be reduced in comparison with the conventional art by the subfield group arrangement construction.

As shown in (b) of FIG. 10, the number of sustain/discharge pulses is minimum in the case of the maximum load ratio, and the idle periods IDLE1, IDLE2, and IDLE3 become maximum.

Accordingly, the starting positions St_2 and St_3 of the second subfield group G2 and the third subfield group G3 advance in time toward the first subfield group G1 in comparison with the case of the minimum load ratio. Additionally, as compared to the case of the minimum load ratio, the first time difference Time_G1G3 decreases and the second time difference Time_G3G1 increases. Consequently, the first time difference Time_G1G3 and the second time difference Time_G3G1 may be equal or similar to each other. In other words, the Time_G1G3=Time_G3G1 or the Time_G1G3≈Time_G3G1.

Accordingly, in the case of the maximum load ratio, the time differences Time_G1G3 and Time_G3G1 between the first subfield group G1 and the third subfield group G3 may have periodicity, which prevents flicker.

The first time difference Time_G1G3 and the second time difference Time_G3G1 may become the same or similar in the case of the maximum load ratio because it is possible to move the starting positions St_2 and St_3 of the second subfield group G2 and the third subfield group G3 using the idle periods generated by the reduction of the number of the sustain/discharge pulses. Therefore, according to the method using the idle periods as described above, the starting positions St_2 and St_3 of the second subfield group G2 and the third subfield group G3 may be moved, according to the level of the load ratio, within a range that reduces flicker.

Figures 4, 5:
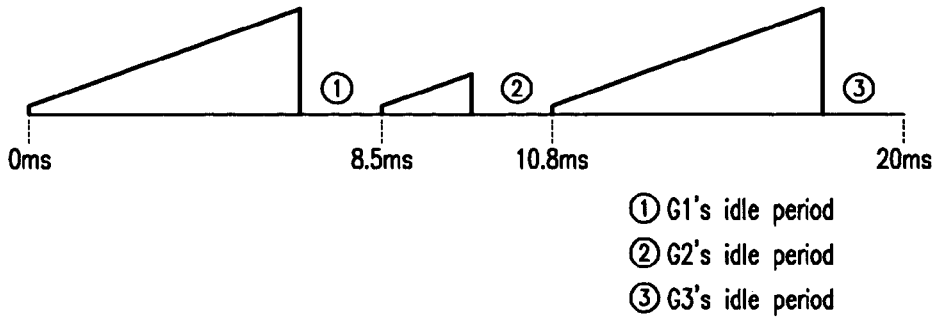
FIG.4 Prior Art
FIG.5 Prior Art
FIG. 4 shows a second conventional PDP subfield arrangement.
FIG. 5 shows an example in which a part of a low gray level is realized with the subfield arrangement of FIG. 4.
Figure 6:
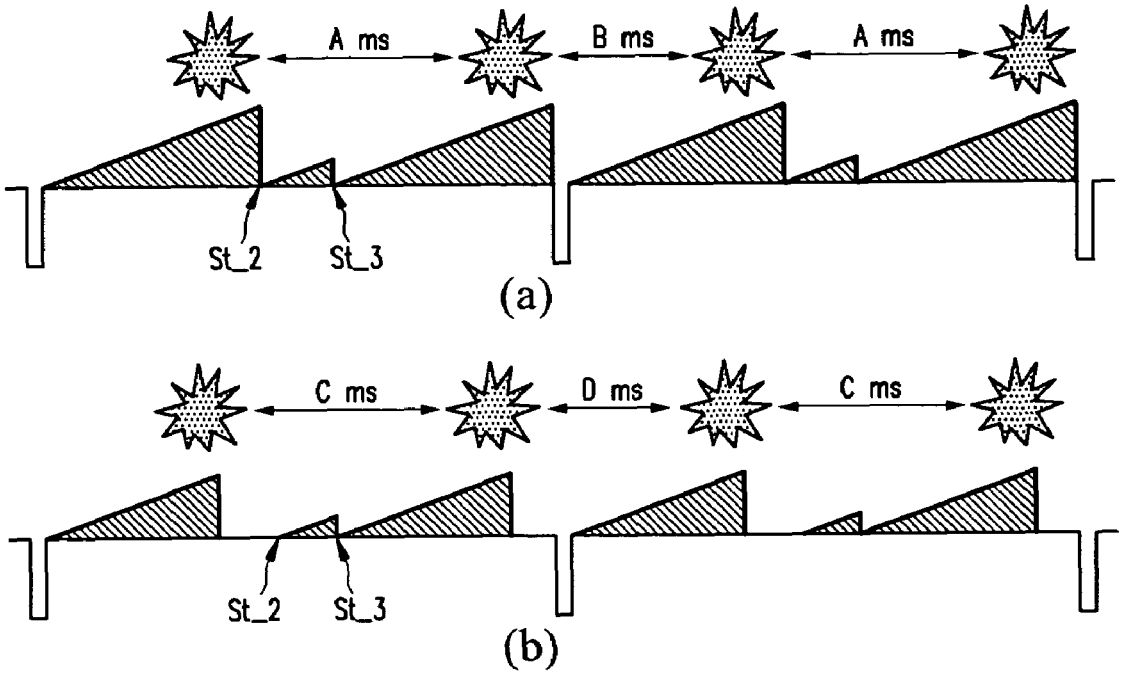
FIG.6 Prior Art
FIG. 6 shows the position of subfields and the central position of illumination for minimum (a) and maximum (b) load ratios according to the conventional subfield construction of FIG. 4.
Figure 11:
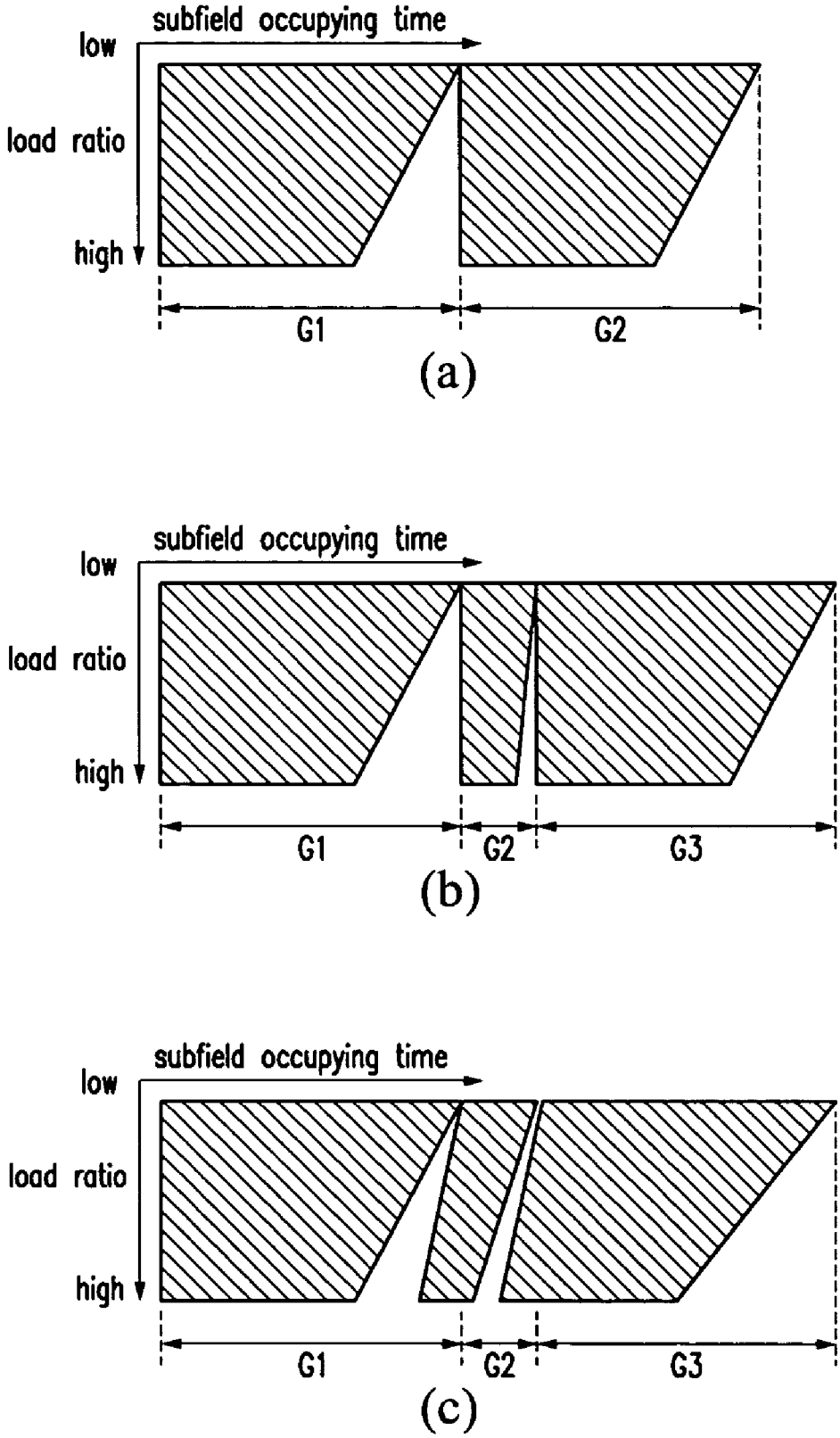
FIG. 11 shows the relation between the APC level and the subfield period (occupied period), in which (a) shows the case of the conventional subfield construction of FIG. 1, (b) shows the case of the conventional subfield construction of FIG. 4, and (c) shows the case of the subfield construction according to an exemplary embodiment of the present invention.

FIG. 11 shows the relation between the APC level and the subfield period (occupied period), in which (a) shows the case of the conventional subfield construction as shown in FIG. 1, (b) shows the case of the conventional subfield construction as shown in FIG. 4, and (c) shows the case of the subfield construction according to an exemplary embodiment of the present invention.

As shown in (a) and (b) of FIG. 11, the subfield groups usually have fixed starting positions in the subfield construction according to the conventional art, so that flicker may occur due to the time difference between the MSB subfields according to the combination of the respective subfields.

However, as shown in (c) of FIG. 11, the starting positions of the respective subfield groups vary according to the load ratio in the subfield construction according to an exemplary embodiment of the present invention. Specifically, the starting positions of the second subfield group G2 and the third subfield group G3 advance in time toward the first subfield group G1 as the load ratio increases, so the time difference between the first subfield group G1 and the third subfield group G3 has the periodicity that may reduce or remove flicker.

Figure 12:
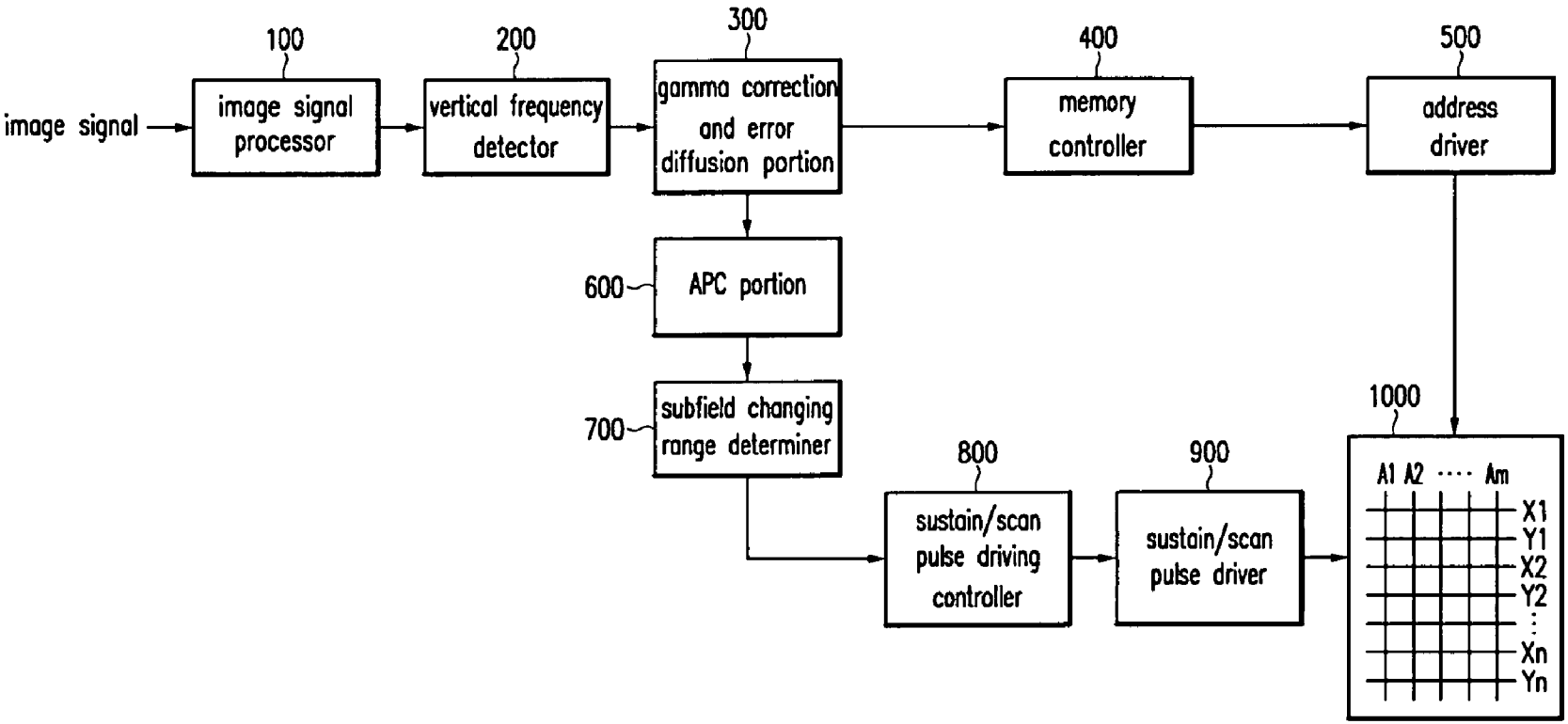
FIG. 12 is a block diagram of an image display apparatus for a PDP according to an exemplary embodiment of the present invention.

FIG. 12 is a block diagram of an image display apparatus for a PDP according to an exemplary embodiment of the present invention.

As shown in FIG. 12, the apparatus for displaying an image on a PDP according to an exemplary embodiment of the present invention comprises an image signal processor 100, a vertical frequency detector 200, a gamma correction and error diffusion portion 300, a memory controller 400, an address driver 500, an APC portion 600, a subfield changing range determiner 700, a sustain/scan pulse driving controller 800, and a sustain/scan pulse driver 900.

The image signal processor 100 digitalizes the input image signal to generate digital image data.

The vertical frequency detector 200 analyzes the digital image data output from the image signal processor 100 to determine whether the input image data is an NTSC signal of 60 Hz or a PAL signal of 50 Hz, and outputs the result as a data switch value together with the digital image data.

The gamma correction and error diffusion portion 300 receives the digital image data output from the vertical frequency detector 200 to simultaneously gamma correct the image data and diffuse the display error with respect to the adjacent pixels. The gamma correction and error diffusion portion 300 outputs the data switch value to the memory controller 400 and the APC portion 600 as it is.

The memory controller 400 receives the data switch value and the digital image data output from the gamma correction and error diffusion portion 300, and generates subfield data corresponding to the input digital image data either as a 50 Hz image signal or as a 60 Hz image signal, according to the data switch value.

When the data switch value indicates the 60 Hz image signal, the subfield data corresponding to the digital image data may be generated according to the conventional method of generating one subfield group.

However, when the data switch value indicates the 50 Hz image signal, as shown in FIG. 7 and (a) and (b) in FIG. 9, the subfield data corresponding to the digital image data is generated as three subfield groups G1, G2, and G3 with the LSB and LSB+1 data located in the second group G2. In the case of the 50 Hz signal, the subfield data is generated so that six subfields exist in the first group G1, two subfields exist in the second group G2, and six subfields exist in the third group G3. The subfield data generated as such is processed to be input to or output from a memory, and is then output to the address driver 500.

The address driver 500 generates the address data corresponding to the subfield data output from the memory controller 400 and applies the address data to the address electrodes $A_1, A_2, \ldots, A_m$ of the PDP 1000.

The APC portion 600 detects the load ratio with the image data output from the gamma correction and error diffusion portion 300, calculates the APC level according to the detected load ratio, and calculates and outputs the number of sustain/discharge pulses corresponding to the calculated APC level.

The subfield changing range determiner 700 determines a changing range of the respective subfield according to the load ratio output from the APC portion 600, particularly the changing range of the second subfield group G2 and the third subfield group G3, and determines the starting positions of the respective subfields within the determined changing range. The changing range of the second subfield group G2 is the range in which the time difference between the starting position of the MSB subfield in the first subfield group G1 and the starting position of the MSB subfield in the third subfield group G3, and the time difference between the starting position of the MSB subfield in the third subfield group G3 and the starting position of the MSB subfield in the first subfield group G1 of the next frame, have periodicity.

The sustain/scan pulse driving controller 800 receives the sustain pulse number, the starting positions of the respective subfields, and the data switch value output from the subfield changing range determiner 700, and, according to the data switch value, generates the subfield arrangement construction separately for the case of a 50 Hz image signal and a 60 Hz image signal and then outputs to the sustain/scan pulse driver 900.

The sustain/scan pulse driver 900 generates the sustain pulses and scan pulses based on the subfield arrangement construction output from the sustain/scan pulse driving controller 800, and applies the scan pulses and the sustain pulses to the scan electrodes $X_1, X_2, \ldots, X_n$ and the sustain electrodes $Y_1, Y_2, \ldots, Y_n$ of PDP 1000.

According to the present invention, flicker may be reduced as the time difference between the central positions of illumination at the subfield groups is periodic.

Further, the pseudo-contour at the low gray level area may be reduced by reducing the time difference between the LSB and LSB+1 of the subfield data, with respect to the 50 Hz PAL image signal.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An apparatus for displaying an image on a plasma display panel that divides an image of each frame displayed thereon in accordance with an image signal to a plurality of subfields and expresses gray level by a combination of luminance weights of the subfields, the apparatus, comprising:

an image signal processor to generate digital image data from the image signal;

a vertical frequency detector for analyzing the digital image data output from the image signal processor to detect a type of the image signal, and outputting a detected result as a data switch value together with the digital image data;

a memory controller for receiving the digital image data and the data switch value generated by the vertical frequency detector, and generating subfield data corresponding to the type of the image signal; wherein the subfield data is comprised of a first subfield group, a second subfield group, and a third subfield group arranged consecutively in time order when the image signal is of a first type;

an automatic power control (APC) portion for detecting a load ratio of the digital image data output from the vertical frequency detector, calculating an APC level according to the detected load ratio, and calculating and outputting a sustain pulse number corresponding to the calculated APC level;

a subfield changing range determiner for determining a changing range of the second subfield group and the third subfield group according to the load ratio output from the APC portion, and determining starting positions of the second subfield group and the third subfield group within the determined changing range; and a sustain/scan pulse driving controller for receiving the sustain pulse number, the starting positions of the second subfield group and the third subfield group, and the data switch value and for generating subfield arrangement construction according to the type of the image signal, and generating a control signal based on the subfield arrangement construction to apply to the plasma display panel.

2. The apparatus of claim 1, wherein the luminance weights of the subfields in the second subfield group are smaller than any one of the luminance weights of a lowermost subfield in the first subfield group and of a lowermost subfield in the third subfield group.

3. The apparatus of claim 1, wherein the subfield changing range determiner sets the starting positions of the second subfield group and the third subfield group ahead of the starting positions of the second subfield group and the third subfield group as the load ratio increases.

4. The apparatus of claim 1, wherein the first type is a Phase Alternating by Line image signal.

5. A method for displaying an image, comprising:

dividing each frame of the image into a plurality of subfield groups; and expressing a gray level by luminance weights of subfields in the plurality of subfield groups, wherein a first subfield group, a second subfield group, and a third subfield group are arranged consecutively in time order;

wherein starting positions of the second subfield group and the third subfield group in time order change according to a load ratio of an input image signal.

6. The method of claim 5, wherein the luminance weights of the subfields in the second subfield group are smaller than any one of the luminance weights of a lowermost subfield in the first subfield group and of a lowermost subfield in the third subfield group.

7. The method of claim 5, wherein the starting positions of the second subfield group and the third subfield group in time order change within a range in which a time difference between a central position of illumination of the first subfield group and a central position of illumination of the third subfield group, and a time difference between the central position of illumination of the third subfield group and a central position of illumination of a first subfield group in a next frame, have periodicity.

8. The method of claim 7, wherein the starting positions of the second subfield group and the third subfield group in time order change within a range such that a time difference between a starting position of a most significant bit (MSB) subfield of the first subfield group and a starting position of a MSB subfield of the third subfield group, and a time difference between the starting position of the MSB subfield in the third subfield group and a starting position of a MSB subfield of the first subfield group in the next frame, have the periodicity.

9. The method of claim 8, wherein the starting positions of the second subfield group and the third subfield group in time order change within a range such that a time difference between the starting position of the MSB subfield of the first subfield group and the starting position of the MSB subfield of the third subfield group, and the time difference between the starting position of the MSB subfield in the third subfield group and the starting position of the MSB subfield of the first subfield group in the next frame, are identical to each other.

10. The method of claim 5, wherein the starting positions of the second subfield group and the third subfield group advance in time order as the load ratio increases.

11. The method of claim 5, wherein a subfield corresponding to a lower bit among subfield data of the frame is included in the second subfield group.

12. The method of claim 11, wherein the lower bit is a least significant bit (LSB).

13. The method of claim 11, wherein the lower bit is an LSB+1.

14. The method of claim 5, wherein a subfield group among the three subfield groups is comprised of subfields with a luminance weight different from that of the remaining two subfield groups.

15. The method of claim 5, wherein the first subfield group and the third subfield group are comprised of subfields having luminance weights that are identical to each other.

16. A method for displaying an image on a plasma display panel, comprising:

dividing an image of each frame displayed thereon in accordance with an image signal into a plurality of subfields; and expressing a gray level by a combination of luminance weights of the plurality of subfields, wherein each of the plurality of subfields comprises three consecutive subfield groups;

wherein central positions of illumination between the three consecutive subfield groups in one frame or in different frames have periodicity when a load ratio of the image signal is larger than a specific value.

* * * * *